US008419923B2

(12) United States Patent
Verdyck et al.

(10) Patent No.: US 8,419,923 B2
(45) Date of Patent: Apr. 16, 2013

(54) LITHOGRAPHIC PRINTING PLATE SUPPORT

(75) Inventors: Dirk Verdyck, Merksem (BE); Paola Campestrini, Antwerp (BE); Marc De Temmerman, Sint Niklaas (BE)

(73) Assignee: Agfa Graphics NV, Mortsel (BE)

( * ) Notice: Subject to any disclaimer, the term of this patent is extended or adjusted under 35 U.S.C. 154(b) by 717 days.

(21) Appl. No.: 12/375,952

(22) PCT Filed: Jul. 6, 2007

(86) PCT No.: PCT/EP2007/056891

§ 371 (c)(1),
(2), (4) Date: Feb. 24, 2010

(87) PCT Pub. No.: WO2008/015073

PCT Pub. Date: Feb. 7, 2008

(65) Prior Publication Data

US 2010/0133112 A1 Jun. 3, 2010

Related U.S. Application Data

(60) Provisional application No. 60/822,065, filed on Aug. 10, 2006.

(30) Foreign Application Priority Data

Aug. 3, 2006 (EP) ..... 06118360

(51) Int. Cl.
*C25F 3/20* (2006.01)

(52) U.S. Cl.
USPC ..... 205/646; 205/661

(58) Field of Classification Search ..... 205/646, 205/661

See application file for complete search history.

(56) References Cited

U.S. PATENT DOCUMENTS

| | | | |
|---|---|---|---|
| 3,635,709 | A | 1/1972 | Kobayashi |
| 3,759,711 | A | 9/1973 | Rauner et al. |
| 3,859,099 | A | 1/1975 | Petropoulos et al. |
| 4,045,232 | A | 8/1977 | Parkinson |
| 4,115,128 | A | 9/1978 | Kita |
| 4,266,001 | A | 5/1981 | Buhr et al. |

(Continued)

FOREIGN PATENT DOCUMENTS

| | | | |
|---|---|---|---|
| CN | 101076448 | A | 11/2007 |
| DE | 1214086 | B | 4/1966 |

(Continued)

*Primary Examiner* — Nicholas A. Smith
(74) *Attorney, Agent, or Firm* — Leydig, Voit & Mayer, Ltd.

(57) ABSTRACT

A method for making a lithographic printing plate support is disclosed comprising the steps of: (i) providing an aluminum support; (ii) treating said support in an aqueous solution; (iii) graining said treated support in an electrolyte solution by applying an alternating voltage thereby inducing a local current density J; characterized in that said local current density J at time t fulfills the following equation: $J(t) \leqq a+bQ(t)$ for t=o to $t=t_f$ and wherein Q(t) is the integrated value of the absolute value of the local current density at time t:(I)—a is equal to 5—b is equal to 10—and $t_f$ is the time necessary to obtain a value of Q(t) equal to 50 C/dm$^2$.

$$Q(t) = \int_0^t |J(\tau)| d\tau$$

36 Claims, 3 Drawing Sheets pre-graining treatment and graining of the aluminum support

U.S. PATENT DOCUMENTS

| | | | | |
|---|---|---|---|---|
| 4,410,621 | A | 10/1983 | Wada et al. | |
| 4,458,005 | A | 7/1984 | Mohr et al. | |
| 4,915,800 | A | 4/1990 | Nakanishi et al. | |
| 4,919,774 | A | 4/1990 | Minato et al. | |
| 4,981,517 | A | 1/1991 | DeSanto, Jr. et al. | |
| 5,045,157 | A | 9/1991 | Nishino et al. | |
| 5,141,838 | A | 8/1992 | Aoshima et al. | |
| 5,163,368 | A | 11/1992 | Pensavecchia et al. | |
| 5,174,205 | A | 12/1992 | Kline et al. | |
| 5,629,354 | A | 5/1997 | West et al. | |
| 5,641,608 | A | 6/1997 | Grunwald et al. | |
| 5,955,238 | A | 9/1999 | Yokoya et al. | |
| 6,010,824 | A | 1/2000 | Komano et al. | |
| 6,027,857 | A | 2/2000 | Li et al. | |
| 6,037,098 | A | 3/2000 | Aoai et al. | |
| 6,071,675 | A | 6/2000 | Teng | |
| 6,140,392 | A | 10/2000 | Kingman et al. | |
| 6,171,735 | B1 | 1/2001 | Li et al. | |
| 6,218,076 | B1 | 4/2001 | Ogata et al. | |
| 6,232,038 | B1 | 5/2001 | Takasaki et al. | |
| 6,245,481 | B1 | 6/2001 | Teng | |
| 6,387,595 | B1 | 5/2002 | Teng | |
| 6,420,089 | B1 | 7/2002 | Baumann et al. | |
| 6,423,206 | B1 | 7/2002 | Haby et al. | |
| 6,482,571 | B1 | 11/2002 | Teng | |
| 6,548,222 | B2 | 4/2003 | Teng | |
| 6,576,401 | B2 | 6/2003 | Teng | |
| 6,589,994 | B1 | 7/2003 | Artman et al. | |
| 6,780,305 | B2 | 8/2004 | Nishino et al. | |
| 7,767,384 | B2 | 8/2010 | Vermeersch et al. | |
| 7,867,572 | B2 | 1/2011 | Andriessen | |
| 8,088,560 | B2 | 1/2012 | Williamson | |
| 8,119,330 | B2 | 2/2012 | Van Damme | |
| 8,232,043 | B2 | 7/2012 | Williamson et al. | |
| 2003/0003406 | A1 | 1/2003 | Grunwald et al. | |
| 2003/0016577 | A1 | 1/2003 | Siek | |
| 2003/0105533 | A1 | 6/2003 | Hirokawa et al. | |
| 2003/0124460 | A1 | 7/2003 | Munnelly et al. | |
| 2004/0013968 | A1 | 1/2004 | Teng | |
| 2004/0063033 | A1 | 4/2004 | Hotta | |
| 2004/0079252 | A1 * | 4/2004 | Sawada et al. | 101/453 |
| 2004/0260050 | A1 | 12/2004 | Munnelly et al. | |
| 2005/0003285 | A1 | 1/2005 | Hayashi et al. | |
| 2005/0123853 | A1 | 6/2005 | Munnelly et al. | |
| 2005/0170286 | A1 | 8/2005 | Huang et al. | |

FOREIGN PATENT DOCUMENTS

| | | | |
|---|---|---|---|
| DE | 1470154 | A1 | 1/1972 |
| DE | 38 42 454 | A1 | 7/1989 |
| DE | 39 10 450 | A1 | 11/1989 |
| DE | 3211312 | A1 | 7/1991 |
| DE | 4001466 | A1 | 7/1991 |
| DE | 4007428 | A1 | 9/1991 |
| DE | 4027301 | A1 | 3/1992 |
| DE | 4417907 | A1 | 11/1995 |
| DE | 4423140 | A1 | 1/1996 |
| DE | 4445820 | A1 | 6/1996 |
| EP | 0024629 | A2 | 3/1981 |
| EP | 0107792 | A1 | 5/1984 |
| EP | 0152819 | A1 | 8/1985 |
| EP | 0215453 | A2 | 3/1987 |
| EP | 0291760 | A2 | 11/1988 |
| EP | 0292801 | A2 | 11/1988 |
| EP | 0339393 | A2 | 11/1989 |
| EP | 0400706 | A1 | 12/1990 |
| EP | 0507088 | A1 | 10/1992 |
| EP | 0537633 | A1 | 4/1993 |
| EP | 0 585 586 | A1 | 3/1994 |
| EP | 0 645 260 | A1 | 3/1995 |
| EP | 0659909 | A1 | 6/1995 |
| EP | 0770494 | A2 | 5/1997 |
| EP | 0770495 | A1 | 5/1997 |
| EP | 0770497 | A1 | 5/1997 |
| EP | 0771645 | A1 | 5/1997 |
| EP | 0773112 | A1 | 5/1997 |
| EP | 0774364 | A1 | 5/1997 |
| EP | 0823327 | A2 | 5/1997 |
| EP | 0849090 | A2 | 6/1998 |
| EP | 0894622 | A2 | 2/1999 |
| EP | 0909657 | A2 | 4/1999 |
| EP | 0933682 | A2 | 8/1999 |
| EP | 0934822 | A1 | 8/1999 |
| EP | 0960729 | A1 | 12/1999 |
| EP | 0960730 | A1 | 12/1999 |
| EP | 0978376 | A2 | 2/2000 |
| EP | 0982123 | A2 | 3/2000 |
| EP | 1029667 | A1 | 8/2000 |
| EP | 1029668 | A2 | 8/2000 |
| EP | 1043627 | A1 | 10/2000 |
| EP | 1053868 | A2 | 11/2000 |
| EP | 1072432 | A2 | 1/2001 |
| EP | 1074386 | A2 | 2/2001 |
| EP | 1074889 | A2 | 2/2001 |
| EP | 1091247 | A2 | 4/2001 |
| EP | 1093934 | A1 | 4/2001 |
| EP | 1120246 | A2 | 8/2001 |
| EP | 1 157 854 | A2 | 11/2001 |
| EP | 1241002 | A2 | 9/2002 |
| EP | 1262318 | A2 | 12/2002 |
| EP | 1267211 | A1 | 12/2002 |
| EP | 1275498 | A2 | 1/2003 |
| EP | 1288720 | A1 | 3/2003 |
| EP | 1 338 436 | A2 | 8/2003 |
| EP | 1341040 | A1 | 9/2003 |
| EP | 1342568 | A1 | 9/2003 |
| EP | 1349006 | A1 | 10/2003 |
| EP | 1369231 | A2 | 12/2003 |
| EP | 1369232 | A2 | 12/2003 |
| EP | 1 396 348 | A2 | 3/2004 |
| EP | 1400351 | A2 | 3/2004 |
| EP | 1543958 | A2 | 6/2005 |
| EP | 1588847 | A1 | 10/2005 |
| EP | 1614538 | A2 | 1/2006 |
| EP | 1614539 | A1 | 1/2006 |
| EP | 1614540 | A1 | 1/2006 |
| EP | 1614541 | A2 | 1/2006 |
| EP | 1545878 | B1 | 9/2006 |
| EP | 1767349 | A1 | 3/2007 |
| EP | 1 826 022 | A1 | 8/2007 |
| EP | 2102522 | B1 | 4/2010 |
| ES | 2324542 | T3 | 8/2009 |
| GB | 739654 | A | 11/1955 |
| GB | 1084070 | A | 9/1967 |
| GB | 2088901 | A | 6/1982 |
| JP | 50113305 | A | 9/1975 |
| JP | 50117503 | A | 9/1975 |
| JP | 55057841 | A | 4/1980 |
| JP | 55076346 | A | 6/1980 |
| JP | 2096755 | A | 4/1990 |
| JP | 6088942 | A | 3/1994 |
| JP | 2004/243633 | A | 9/2004 |
| WO | WO 93/05446 | | 3/1993 |
| WO | WO 97/39894 | | 10/1997 |
| WO | WO 99/01795 | | 1/1999 |
| WO | WO 99/21715 | | 5/1999 |
| WO | WO 99/63407 | | 12/1999 |
| WO | WO 00/29214 | | 5/2000 |
| WO | WO 00/32705 | | 6/2000 |
| WO | WO 03/087939 | A2 | 10/2003 |
| WO | WO 2004/018268 | A1 | 3/2004 |
| WO | WO 2004/030923 | A2 | 4/2004 |
| WO | WO 2004/030924 | A1 | 4/2004 |
| WO | WO 2004/030925 | A1 | 4/2004 |
| WO | WO 2004/071767 | A1 | 8/2004 |
| WO | WO 2005/058605 | A1 | 6/2005 |
| WO | WO 2005/111727 | A1 | 11/2005 |
| WO | WO 2007/045515 | A1 | 4/2007 |
| WO | WO 2008/052785 | A1 | 5/2008 |
| WO | WO 2008/073307 | A2 | 6/2008 |
| WO | WO 2008/073310 | A1 | 6/2008 |
| WO | WO 2008/083448 | A1 | 6/2008 |
| WO | WO 2008/089038 | A1 | 7/2008 |

* cited by examiner

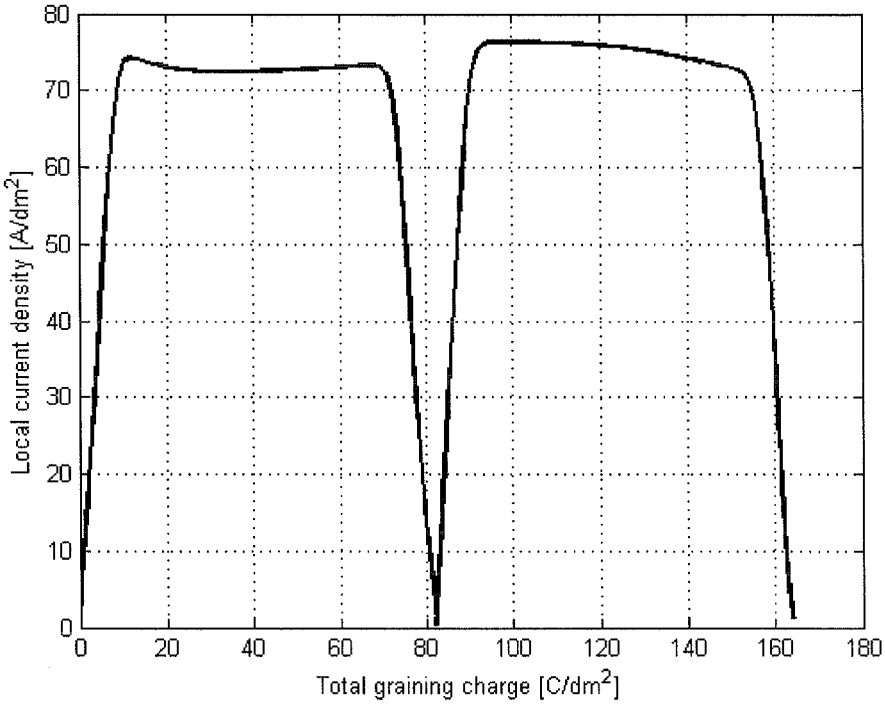
Figure 1: J/Q diagram of a graining process.
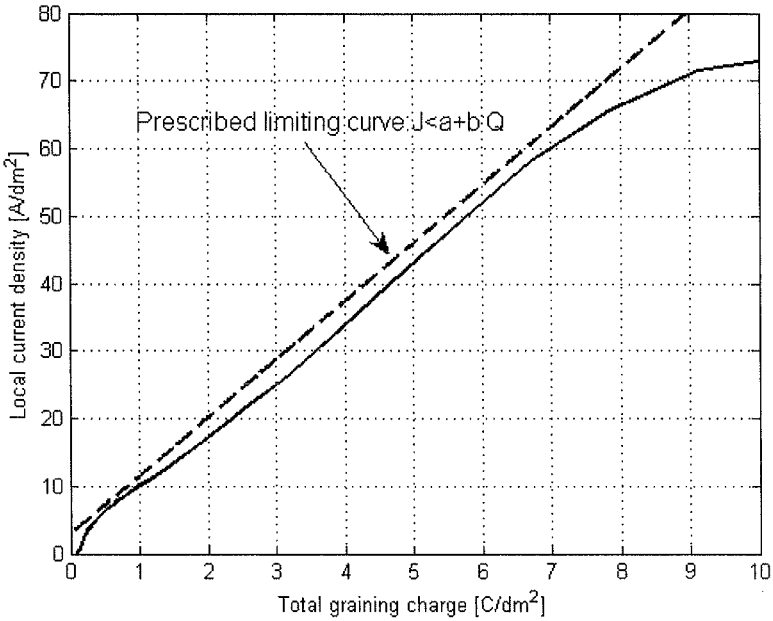
Figure 2: J/Q diagram during first 10 $C/dm^2$

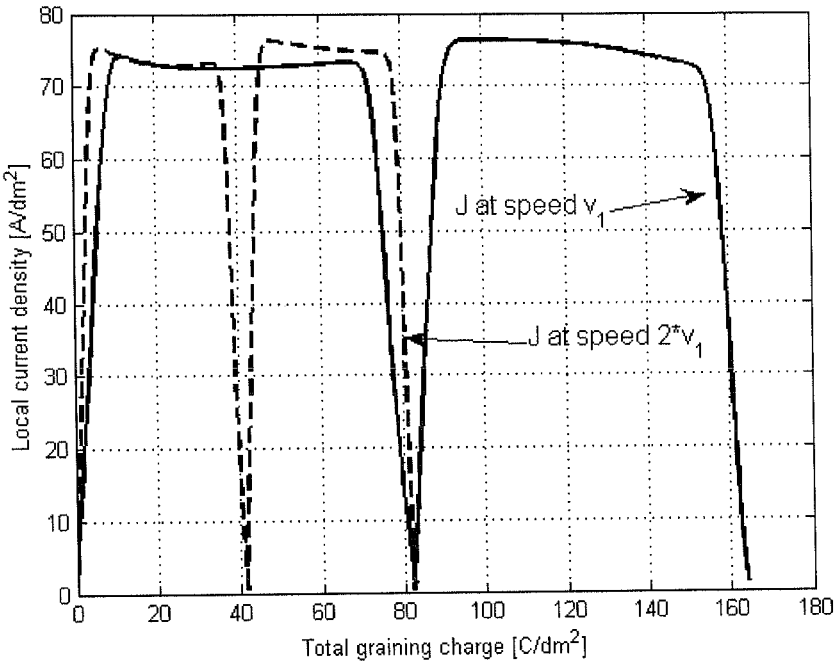
Figure 3: J/Q diagram at two different web speeds.
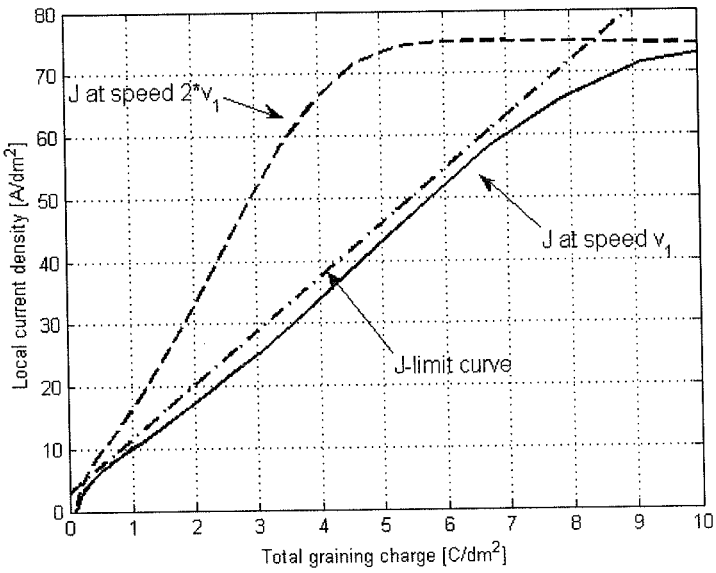
Figure 4: J/Q diagram during first 10 $C/dm^2$ at two different web speeds.

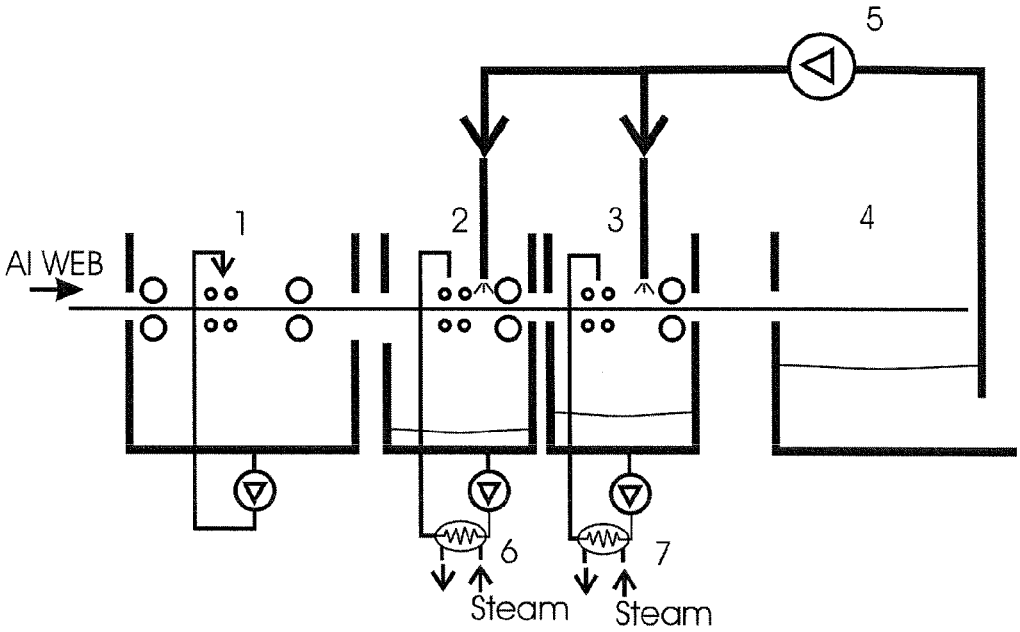
Figure 5: pre-graining treatment and graining of the aluminum support.
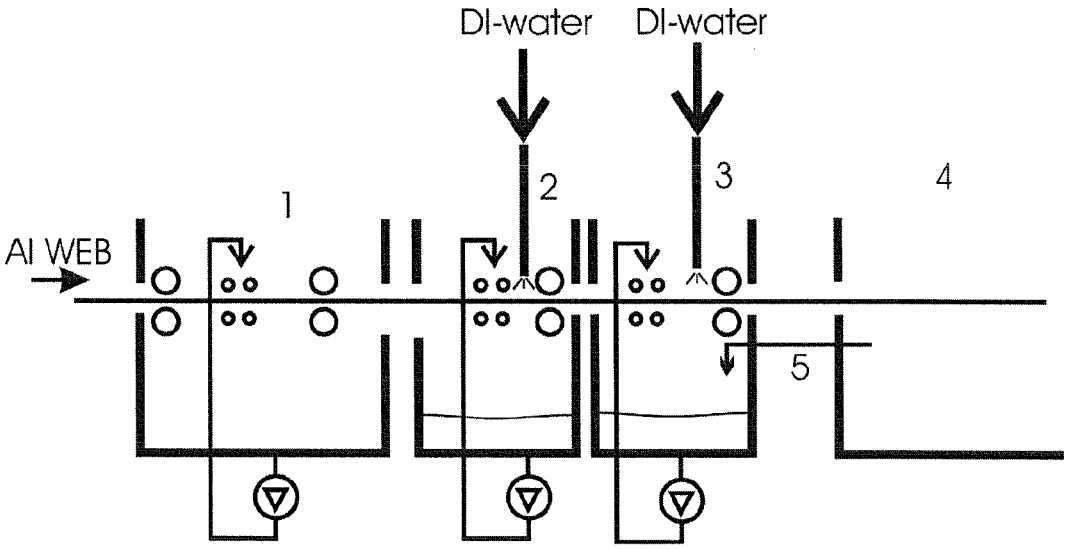
Figure 6: pre-graining treatment and graining according to the prior art.

LITHOGRAPHIC PRINTING PLATE SUPPORT

FIELD OF THE INVENTION

The present invention relates to a method for making a lithographic printing plate support and to a method for making a heat- and/or light sensitive, lithographic printing plate precursor comprising said support.

BACKGROUND OF THE INVENTION

The Lithographic printing presses use a so-called printing master such as a printing plate which is mounted on a cylinder of the printing press. The master carries a lithographic image on its surface and a print is obtained by applying ink to said image and then transferring the ink from the master onto a receiver material, which is typically paper. In conventional, so-called "wet" lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. In so-called driographic printing, the lithographic image consists of ink-accepting and ink-abhesive (ink-repelling) areas and during driographic printing, only ink is supplied to the master.

Printing masters are generally obtained by the image-wise exposure and processing of an imaging material called plate precursor. In addition to the well-known photosensitive, so-called pre-sensitized plates, which are suitable for UV contact exposure through a film mask, also heat-sensitive printing plate precursors have become very popular in the late 1990s. Such thermal materials offer the advantage of daylight stability and are especially used in the so-called computer-to-plate method wherein the plate precursor is directly exposed, i.e. without the use of a film mask. The material is exposed to heat or to infrared light and the generated heat triggers a (physico-) chemical process, such as ablation, polymerization, insolubilization by cross linking of a polymer, heat-induced solubilization, or by particle coagulation of a thermoplastic polymer latex.

Examples of light sensitive printing plates include UV-sensitive pre-sensitized plates which may be based on a positive or negative working mechanism. Typical examples of positive working plates have an imaging layer comprising an o-naphtoquinonediazide compound (NQD) and an alkali soluble resin. The negative working pre-sensitized plates preferably comprise a diazonium salt, a diazonium resin or an aryldiazosulfonate homo- or copolymer. Examples of diazo resins include condensation products of an aromatic diazonium salt as described in for example DE 1 214 086. Light sensitive printing plates based on a photo-polymerisation reaction typically contain a coating comprising a photocurable composition comprising a free radical initiator, a polymerizable compound and a polymeric binder.

In general, aluminum substrates are used as supports for lithographic printing plates. The use of aluminum substrates as supports requires that they undergo several treatments such as for example graining and anodizing. Lithographic supports are roughened or grained to improve the adhesion of an imaging layer to the support and anodizing may be carried out to improve the abrasion resistance and water retention or wetting characteristics of the non-image areas of the support.

The aluminum support is typically roughened or grained by a process including:

(i) a mechanical roughening step: for example scraping mechanically the aluminum support; and/or (ii) an electrochemical roughening step: electrolyzing the surface of the aluminum support in an electrolyte solution using the support as an electrode and for example graphite as counter electrode.

By varying the type and/or concentration of the electrolyte solution and the applied voltage in the electrochemical roughening step, different type of grains can be obtained. Usually an alternating current such as a sine wave current, a trapezoidal wave current, or a rectangular wave current is applied while the aluminum support is immersed in an acidic electrolyte solution. Thus, the support is alternately subjected to a positive and a negative voltage at the entrance of an electrolysis cell. When the positive voltage is applied, a cathodic reaction occurs on the surface of the aluminum; when the negative voltage is applied, an anodic reaction occurs. During the cathodic reaction, an oxide layer is formed and when the anodic reaction occurs, the oxide layer is resolved into the acidic electrolyte to form honeycomb-shaped pits on the surface of the substrate. The surface of an unroughened aluminum printing plate support behaves in a nonlinear fashion when an electric current is applied to it due to the presence of for example aluminum oxide at the surface. Therefore, the current density is not only dependent on the applied voltage but additionally on the nature of the surface. The anodic started current tends to start a graining pattern that looks different from a cathodic started current graining, in that sense that more local larger pits are formed resulting in an inhomogeneous graining pattern. The graining pattern in a region where the cathodic current started, is much more homogeneously distributed over the whole surface. This difference in behaviour between the anodic and cathodic started areas in the graining process is especially observed at low current densities, typically during the first 100 $C/dm^2$. Above 100 $C/dm^2$, a homogeneous graining pattern will be superimposed on the inhomogeneous graining already present at that moment. This results in an optical difference between the anodic and the cathodic started areas and the human eye is able to percept this as so-called chattermarks. Chattermarks appear as a Moiré-pattern on the surface of a grained aluminum support. The tendency for the appearance of chattermarks on the aluminum surface is higher when a high current density is applied at the beginning of the electrochemical roughening. Many attempts have been carried out in the prior art to avoid these surface defects by modifying the graining conditions.

DE 38 42 454 C2 discloses a method wherein the surface of the printing plate substrate is provided with an additional layer whereby non-uniformities in the material that essentially cause spots are compensated for.

U.S. Pat. No. 6,423,206 discloses a method for electrochemically roughening the surface of the substrate in an aqueous electrolyte bath by the application of an alternating or three-phase current to special shaped electrodes opposite to the substrate, while the substrate is passed continuously through the electrolyte bath.

DE 39 10 450 C2 describes a method for producing a printing plate substrate in which the surface of said substrate is roughened electrochemically in an acidic electrolyte solution using an alternating current at a frequency of 80-100 Hz, and in which the ratio of anode time to period time is from 0.25 to 0.20.

EP 0 585 586 discloses a method wherein a constant imposition of equal-sized positive and negative half-waves of the alternating current is applied to the surface of a printing plate substrate.

U.S. Pat. No. 4,919,774 discloses a method of graining a metal web in an electrolytic liquid using an alternating waveform current and whereby the ratio of the current value contributing to an anode and to a cathode reaction occurring on the surface of said metal web is controlled by shunting a part of the current value as a direct current into an auxiliary anode electrode provided separately from a pair of main electrodes.

U.S. Pat. No. 6,780,305 discloses a method for making an aluminum printing plate support, which can be produced from recycled aluminum, scrapped aluminum and regenerated aluminum, comprising a surface roughening step including (1) a pre-electrolytic surface roughening in an aqueous hydrochloric acid solution with an alternating or direct current applied thereto, (2) an alkali-etching step (3) a desmutting step with sulphuric acid and (4) an electrolytic surface-roughening step in an aqueous nitric acid solution with an alternating current being applied thereto.

US 2003\0105533 discloses an electrolysis apparatus wherein a support is conveyed at a high current density and a high conveyance velocity and which comprises a plurality of electrolysis cell arranged in series. An alternating current is applied so that the current density is lower at an electrolysis cell located at a most down-stream position compared to an electrolysis cell located upstream with respect to the conveyance direction.

JP 2004\243,633 discloses a method for making a printing plate support comprising an electrochemical surface roughening treatment using alternating current D ranging from 20 to 200 A/dm$^2$, and a travel speed V through the electrolytic batch ranging from 70 to 160 m/min and wherein $D \leqq 122000 \times [V]^{-1.55}$.

EP 1,338,436 discloses a method for making an aluminum support comprising a graining step in a hydrochloric acid solution comprising chloride hexahydrate during which an alternating current is applied under the condition that the ratio of the quantity of electricity in the cathodic state $Q_c$ and the quantity of the electricity in the anodic state $Q_a$ is 0.9 to 1.0.

The methods and apparatuses proposed in the prior art for improving the surface characteristics of roughened aluminum are often complex and require a major expenditure for circuitry.

SUMMARY OF THE INVENTION

It is an object of the present invention to provide a convenient method for making a lithographic aluminum printing plate support that does not show chattermarks on its surface.

This object is realized by the method of claim 1; i.e. a method for making a lithographic printing plate support which comprises the steps of:

(i) providing an aluminum support;

(ii) treating said support in an aqueous solution;

(iii) graining said treated support in an electrolyte solution by applying an alternating voltage to said support thereby inducing a local current density J at the surface of said support, characterized in that said local current density J at time t fulfills the following equation:

$$J(t) \leqq a + bQ(t) \text{ for } t=o \text{ to } t=t_f$$

and wherein

Q(t) is the integrated value of the absolute value of the local current density at time t:

$$Q(t) = \int_0^t |J(\tau)| d\tau$$

a is equal to 5 b is equal to 10 and $t_f$ is the time necessary to obtain a value of Q(t) equal to 50 C/dm$^2$.

The time frame t to $t_f$ may be of the order of a few periods of the alternating voltage frequency used during the graining process.

In a preferred embodiment, step (ii) is performed in one or more washing bath(s) and step (iii) is performed in one or more graining bath(s) and the level of the aqueous solution present in the washing bath(s) is kept at a constant level by actively pumping the electrolyte solution from the graining bath(s) to the washing bath(s) (FIG. 5).

It is a further object of the present invention to provide a method for making a printing plate precursor comprising the printing plate support as described above. This object is realized by a method for making a lithographic printing plate precursor comprising the steps of:

(i) providing a support according to the method described above;

(ii) applying a coating comprising at least one heat- or light-sensitive imaging layer onto said support;

(iii) drying the obtained precursor.

Other features, elements, steps, characteristics and advantages of the present invention will become more apparent from the following detailed description of preferred embodiments of the present invention.

BRIEF DESCRIPTION OF THE DRAWINGS

FIG. 1 depicts current density J as a function of graining charge Q in a graining process.

FIG. 2 depicts current density J as a function of graining charge Q during the first 10 C/dm2 part of a graining process.

FIG. 3 depicts current density J as a function of graining charge Q at two different web speeds.

FIG. 4 depicts current density J as a function of graining charge Q during the first 10 C/dm$^2$ part at two different web speeds.

FIG. 5 depicts a schematic of the pre-treatment and graining of the aluminum support in accordance with an embodiment of the invention.

FIG. 6 depicts a schematic of the pre-treatment and graining of an aluminum support according to prior art.

DETAILED DESCRIPTION OF THE INVENTION

The lithographic printing plate support according to the method of the present invention is an aluminum support. The surface of the aluminum support is grained and anodized aluminum. The support may be a sheet-like material such as a plate or it may be a cylindrical element such as a sleeve which can be slid around a print cylinder of a printing press.

The surface of the support is grained using an electrolyte solution comprising preferably at least one of the following chemicals: $HNO_3$, HCl, $CH_3COOH$ and/or $H_3PO_4$ or combinations thereof. In a preferred embodiment the electrolyte solution contains HCl. The electrolyte solution may contain other chemicals such as surfactants or salts. The concentration of HCl, $HNO_3$, $CH_3COOH$ and/or $H_3PO_4$ in the electrolyte solution preferably varies between 1 g/l and 50 g/l. More preferably between 5 g/l and 30 g/l; most preferably between 7 g/l and 20 g/l. The graining may be carried out using alternating current at a voltage ranging for example from 5V to 40V, preferably from 9V to 24V for a period ranging from 5 to 60 seconds. The temperature of the electrolyte solution preferably ranges from 20° C. to 55° C., more preferably from 30° C. to 45° C.

In the electrochemical roughening step an alternating current is applied whereby the support is alternately subjected to a positive and a negative voltage at the line frequency, which is e.g. 50 Hz in Europe and 60 Hz in the United States. As a result, an Alternating Current or AC current density J ($A/dm^2$) will locally occur at the surface of the support and a smut layer containing $Al_2OH_3$ will be built up. The total AC graining charge Q ($C/dm^2$) that has passed that local surface over a time period is defined as the integral of the absolute value of J, making abstraction of the sign of the current (Equation 1):

$$Q(t) = \int_0^t |J(\tau)|d\tau [C/dm^2] \text{ for } t = 0 \text{ to } t = t_f \quad \text{(Equation 1)}$$

The time frame $t_f$ may be of the order of a few periods of the alternating voltage frequency used during the graining process.

The obtained J and Q values can be put into a graphical diagram (FIG. 1), wherein the graining charge Q represents the x-axis and the current density J the y-axis. As the graining charge increases during the graining process, the x-coordinate in the J/Q diagram increases during the graining process. The graining charge is thus similar to the time, but it is different from the time as it is the result of an integration of the current density over the time. The current density on the other hand, increases when entering a zone between electrochemical electrodes, remains constant within said zone and decreases when leaving said zone. The JQ-diagram gives very accurate information of the built-up of the smut layer during the electrochemical graining process. The independent coordinate time is not present in this diagram and plays no role for the smut layer built-up. The JQ-diagram of the electrochemical graining process mainly depends on the geometry of the electrodes such as shape and rounding, the applied voltage and the speed of the support during graining but not on the time.

The practical measurement of the JQ-diagram however is difficult. As a support is moving through the electrolytic cells, a current probe system should move simultaneously which is not that obvious. Furthermore, the environment in the electrolyte is very aggressive and not compatible with electronics. Also, because the distance of the support to the electrode is small there is no room for mounting electronics. Also, any mounting of a system for measuring the current density, would probably influence the local current density at the surface of the support which would influence the final JQ-curve. Therefore, in practice, the JQ-curve can only be calculated. The skilled person is aware of the many commercially available software programs that allow to construct the JQ diagram on the basis of resistance values of the smut layer which can be measured in a lab set up. For a given electrode geometry, aluminum support to electrode distance and web speed, the JQ diagram can be constructed.

According to the method of the present invention it was found that only the first part of the JQ-curve—i.e. preferably only up to 80 $C/dm^2$ of graining charge Q, more preferably up to 50 $C/dm^2$ and most preferably up to 10 $C/dm^2$—is important for chattermark formation. Within this initial range of total current charge Q, a limit curve has been established which defines the area were chattermarks will not occur. In the first part of the JQ-curve of the first cycle of a graining process (FIG. 2), a limiting curve has been approximated by a straight line and is defined with equation 4:

$$J(t) \leqq a + bQ(t) [A/dm^2] \text{ for t=o to t=}t_f \quad \text{(Equation 4)}$$

wherein

Q(t) is the integrated value of the absolute value of the local current density at time t:

$$Q(t) = \int_0^t |J(\tau)|d\tau$$

a is equal to 5, preferably a is equal to 3.5 and most preferably a is equal to 2.9;

b is equal to 10, preferably b is equal to 9.0 and most preferably b is equal to 8.6; alternatively b is preferably ≦8.6; and and $t_f$ is the time necessary to obtain a value of $Q(t=t_f)$ preferably equal to 80 $C/dm^2$, more preferably equal to 50 $C/dm^2$ and most preferably equal to 10 $C/dm^2$.

For the first 80 $C/dm^2$, more preferably for the first 50 $C/dm^2$ and most preferably for the first 10 $C/dm^2$, the 'real' graining current should be below the defined limit curve in the J/Q diagram for preventing chattermarks. When the current density is slowly increased and remains below the limit curve, no chattermarks will occur. When the current density built-up is too fast and becomes higher than the limit curve, a memory effect can for example be initiated in the local graining morphology which can result in a moiré-pattern i.e. chattermarks.

The current density J may get above this limiting curve by for example increasing the speed of the support in the graining step, the construction and geometry of the first electrode and/or the application of a too high voltage at the beginning of the graining step. At low speeds of the support, the built up of the current density J is slow with regard to the graining charge Q while at higher speeds of the support, the built up of J is much faster. FIGS. 3 and 4 show a JQ-diagram for both cases. In FIG. 3 the first cycles of a graining process are shown for two speeds $v_1$ and $v_2=2\cdot v_1$; FIG. 4 is a magnification of the first part of FIG. 3, i.e. for a graining charge Q in the range from 0 to 10 $C/dm^2$ and represents the initial current density during the first cycles of the graining process. In FIG. 4 it is illustrated that at high speeds of the support, the resulting current density values are higher than the current density values obtained at low speeds during the first 10 $C/dm^2$ of graining charge. When the J values are above the limit curve, the risk of chattermarks is high. The specific design of the electrodes may compensate for a high speed of the support.

It was further surprisingly found that treating an aluminium support in an aqueous solution comprising electrolyte solution, without applying a voltage, prior to graining said aluminum support in an electrolyte solution drastically reduces the occurrence of chatter marks. It was found that the position of the straight line defined in Equation 4 is strongly influenced by the chemical composition of the aqueous solution used in the treatment prior to the graining step. By treating the support with an aqueous solution having a low content of electrolyte solution, the support will be more chattermark sensitive and the limit J value will decrease. Or in other words, for an applied voltage, the obtained current density will be higher than the limit defined by the straight line defined by Equation 4 and chattermarks will most probably occur. Thus the sensitivity of the support to chattermarks will increase when the aqueous solution used in the treatment prior to graining has a low electrolyte content. By treating the support with an aqueous solution having a high electrolyte content on the other hand, then the obtained current density J will be below the straight line defined by Equation 4 and no chattermarks will occur. Most preferably the aqueous solution has the same chemical composition as the electrolyte solution used in the graining step. The content of chlorine ions in the aqueous solution may also influence the position of the straight line defining the limit current density.

Furthermore, it was also found that by reducing the temperature during the treatment prior to the graining step, the support becomes more sensitive to chattermarks and the limit current density Preferably the temperature of the aqueous solution is at least 30° C., more preferably at least 35° C. Alternatively the temperature ranges from 25° C. to 80° C., more preferably from 30° C. to 50° C. and most preferably from 35° C. to 45° C.

In a preferred embodiment, the pre-graining treatment is performed in one or more washing bath(s) and the graining is performed in one or more graining bath(s) and the level of the aqueous solution present in the washing bath(s) is kept at a constant level by pumping the electrolyte solution from the graining bath(s) to the washing bath(s). A typical example of this embodiment is schematically shown in FIG. 5. The aluminium support is first conveyed through a degreasing bath (1) comprising an aqueous solution which typically comprises 5 g/l to 50 g/l sodium hydroxide. The bath temperature usually ranges from 25° C. to 80° C. Then the support is transported into the washing baths (2) and (3) comprising an aqueous solution. Finally the support is grained in the graining bath (4) comprising electrolyte solution. When the level in the washing baths becomes too low, the electrolyte solution is pumped from the graining bath into the washing baths via pump system (5). The temperature in the washing baths is preferably controlled by the heat exchangers (6) and (7). Preferably the temperature in the washing baths is at least 30° C., more preferably at least 35° C. Alternatively the temperature ranges from 30° C. to 80° C., more preferably from 35° C. to 50° C. and most preferably from 35° C. to 45° C. In a preferred embodiment the aqueous solution in the washing baths comprises electrolyte solution, and most preferred, the chemical composition of the aqueous solution in the washing baths is equal to the electrolyte solution of the graining step.

A typical example of the prior art is shown in FIG. 6. The aluminium support is conveyed through a degreasing bath (1), the washing baths (2) and (3) and finally through the graining bath (4). Here, the temperature of the washing baths is not controlled and the level of the washing baths is kept constant by adding de-ionized water instead of pure electrolyte; an overflow (5) may be present between the graining solution and the washing baths but no pump system is present.

The aluminum is preferably anodized by means of anodizing techniques employing sulphuric acid and/or a sulphuric acid/phosphoric acid mixture. By anodizing the aluminum support, its abrasion resistance and hydrophilic nature are improved. The microstructure as well as the thickness of the $Al_2O_3$ layer are determined by the anodizing step, the anodic weight (g/m$^2$ $Al_2O_3$ formed on the aluminum surface) varies between 1 and 8 g/m$^2$. Methods of anodizing are known in the art and are for example disclosed in GB 2,088,901.

The grained and anodized aluminum substrate of the present invention may be post-treated to further improve the hydrophilic properties of its surface. For example, the aluminum oxide surface may be silicated by treatment with a sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with an organic acid and/or salt thereof, e.g. carboxylic acids, hydrocarboxylic acids, sulphonic acids or phosphonic acids, or their salts, e.g. succinates, phosphates, phosphonates, sulphates, and sulphonates. A citric acid or citrate solution is preferred. This treatment may be carried out at room temperature or may be carried out at a slightly elevated temperature of about 30° C. to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulphonic acid, polyvinylbenzenesulphonic acid, sulfuric acid esters of polyvinyl alcohol, and acetals of polyvinyl alcohols formed by reaction with a sulfonated aliphatic aldehyde. It is further evident that one or more of these post treatments may be carried out alone or in combination. More detailed descriptions of these treatments are given in GB 1084070, DE 4423140, DE 4417907, EP 659909, EP 537633, DE 4001466, EP A 292801, EP A 291760 and U.S. Pat. No. 4,458,005.

According to the method of one of the preferred embodiments of the present invention, there is also provided a method for making a lithographic printing plate precursor comprising the steps of providing a support as discussed in detail above, applying a coating solution comprising at least one heat- or light-sensitive imaging layer onto said support and than drying the obtained precursor.

The precursor can be negative or positive working, i.e. can form ink-accepting areas at exposed or at non-exposed areas respectively. Below, the heat- and light-sensitive coatings are discussed in detail.

Heat-Sensitive Printing Plate Precursors.

The imaging mechanism of thermal printing plate precursors can be triggered by direct exposure to heat, e.g. by means of a thermal head, or by the light absorption of one or more compounds in the coating that are capable of converting light, more preferably infrared light, into heat.

A first suitable example of a thermal printing plate precursor is a precursor based on heat-induced coalescence of hydrophobic thermoplastic polymer particles which are preferably dispersed in a hydrophilic binder, as described in e.g. EP 770 494; EP 770 495; EP 770 497; EP 773 112; EP 774 364; EP 849 090, EP 1614538, EP 1614539, EP 1614540, U.S. Pat. No. 7,767,384, WO 2007/045515, U.S. Pat. No. 7,867,572, EP 1767349, and CN 101076448.

In a second suitable embodiment, the thermal printing plate precursor comprises a coating comprising an aryldiazosulfonate homo- or copolymer which is hydrophilic and soluble in the processing liquid before exposure to heat or UV light and rendered hydrophobic and less soluble after such exposure.

Preferred examples of such aryldiazosulfonate polymers are the compounds which can be prepared by homo- or copolymerization of aryldiazosulfonate monomers with other aryldiazosulfonate monomers and/or with vinyl monomers such as (meth)acrylic acid or esters thereof, (meth)acrylamide, acrylonitrile, vinylacetate, vinylchloride, vinylidene chloride, styrene, α-methyl styrene etc. Suitable aryldiazosulfonate monomers are disclosed in EP-A 339393, EP-A 507008 and EP-A 771645 and suitable aryldiazosulfonate polymers are disclosed in EP 507,008, EP 960,729, EP 960,730 and EP1,267,211.

A further suitable thermal printing plate is positive working and relies on heat-induced solubilization of an oleophilic resin. The oleophilic resin is preferably a polymer that is soluble in an aqueous developer, more preferably an aqueous alkaline developing solution with a pH between 7.5 and 14. Preferred polymers are phenolic resins e.g. novolac, resoles, polyvinyl phenols and carboxy substituted polymers. Typical examples of these polymers are described in DE-A-4007428, DE-A-4027301 and DE-A-4445820. The amount of phenolic resin present in the first layer is preferably at least 50% by weight, preferably at least 80% by weight relative to the total weight of all the components present in the first layer.

In a preferred embodiment, the oleophilic resin is preferably a phenolic resin wherein the phenyl group or the hydroxy group is chemically modified with an organic substituent. The phenolic resins which are chemically modified with an organic substituent may exhibit an increased chemical resistance against printing chemicals such as fountain solutions or press chemicals such as plate cleaners. Examples of such chemically modified phenolic resins are described in EP-A 0 934 822, EP-A 1 072 432, U.S. Pat. No. 5,641,608, EP-A 0 982 123, WO 99/01795, EP-A 02 102 446, EP-A 02 102 444, EP-A 02 102 445, EP-A 02 102 443, EP-A 03 102 522. The modified resins described in EP-A 02 102 446, are preferred, especially those resins wherein the phenyl-group of said phenolic resin is substituted with a group having the structure —N═N-Q, wherein the —N═N-group is covalently bound to a carbon atom of the phenyl group and wherein Q is an aromatic group.

In the latter embodiment the coating may comprise a second layer that comprises a polymer or copolymer (i.e. (co) polymer) comprising at least one monomeric unit that comprises at least one sulfonamide group. This layer is located between the layer described above comprising the oleophilic resin and the hydrophilic support. Hereinafter, 'a (co)polymer comprising at least one monomeric unit that comprises at least one sulfonamide group' is also referred to as "a sulphonamide (co)polymer". The sulphonamide (co)polymer is preferably alkali soluble. The sulphonamide group is preferably represented by —NR—$SO_2$—, —$SO_2$—NR— or —$SO_2$—NRR' wherein R and R' each independently represent hydrogen or an organic substituent.

Sulfonamide (co)polymers are preferably high molecular weight compounds prepared by homopolymerization of monomeric units containing at least one sulfonamide group or by copolymerization of such monomeric units and other polymerizable monomeric units.

Examples of monomeric units containing at least one sulfonamide group include monomeric units further containing at least one polymerizable unsaturated bond such as an acryloyl, allyl or vinyloxy group. Suitable examples are disclosed in U.S. Pat. No. 5,141,838, EP 1545878, EP 909,657, EP 0 894 622 and EP 1,120,246.

Examples of monomeric units copolymerized with the monomeric units containing at least one sulfonamide group include monomeric units as disclosed in EP 1,262,318, EP 1,275,498, EP 909,657, EP 1,120,246, EP 0 894 622 and EP 1,400,351.

Suitable examples of sulfonamide (co)polymers and/or their method of preparation are disclosed in EP-A 933 682, EP-A 982 123, EP-A 1 072 432, WO 99/63407 and EP 1,400, 351.

A highly preferred example of a sulfonamide (co)polymer is a homopolymer or copolymer comprising a structural unit represented by the following general formula is (I):

(I)

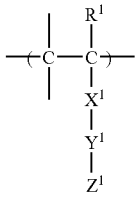

wherein:

$R^1$ represents hydrogen or a hydrocarbon group having up to 12 carbon atoms; preferably $R^1$ represents hydrogen or a methyl group;

$X^1$ represents a single bond or a divalent linking group. The divalent linking group may have up to 20 carbon atoms and may contain at least one atom selected from C, H, N, O and S.

Preferred divalent linking groups are a linear alkylene group having 1 to 18 carbon atoms, a linear, branched, or cyclic group having 3 to 18 carbon atoms, an alkynylene group having 2 to 18 carbon atoms and an arylene group having 6 to 20 atoms, —O—, —S—, —CO—, —CO—O—, —O—CO—, —CS—, —$NR^hR^i$—, —CO—$NR^h$—, —$NR^h$—CO—, —$NR^h$—CO—O—, —O—CO—$NR^h$—, —$NR^h$—CO—$NR^i$—, —$NR^h$—CS—$NR^i$—, a phenylene group, a naphtalene group, an anthracene group, a heterocyclic group, or combinations thereof, wherein $R^h$ and $R^i$ each independently represent hydrogen or an optionally substituted alkyl, alkenyl, alkynyl, cycloalkyl, heterocyclic, aryl, heteroaryl, aralkyl or heteroaralkyl group. Preferred substituents on the latter groups are an alkoxy group having up to 12 carbon atoms, a halogen or a hydroxyl group. Preferably $X^1$ is a methylene group, an ethylene group, a propylene group, a butylene group, an isopropylene group, cyclohexylene group, a phenylene group, a tolylene group or a biphenylene group;

$Y^1$ is a bivalent sulphonamide group represented by —$NR^j$—$SO_2$— or —$SO_2$—$NR^k$— wherein $R^j$ and $R^k$ each independently represent hydrogen, an optionally substituted alkyl, alkanoyl, alkenyl, alkynyl, cycloalkyl, heterocyclic, aryl, heteroaryl, aralkyl or heteroaralkyl group or a group of the formula —C(═N)—NH—$R^2$, wherein $R^2$ represents hydrogen or an optionally substituted alkyl or aryl group;

$Z^1$ represents a bi-, tri- or quadrivalent linking group or a terminal group. When $Z^1$ is a bi-, tri- or quadrivalent linking group, the remaining 1 to 3 bonds of $Z^1$ are linked to $Y^1$ forming crosslinked structural units.

When $Z^1$ is a terminal group, it is preferably represented by hydrogen or an optionally substituted linear, branched, or cyclic alkylene or alkyl group having 1 to 18 carbon atoms such as a methyl group, an ethyl group, a propyl group, an isopropyl group, a butyl group, an isobutyl group, a t-butyl group, a s-butyl group, a pentyl group, a hexyl group, a cyclopentyl group, a cyclohexyl group, an octyl group, an optionally substituted arylene or aryl group having 6 to 20 carbon atoms; an optionally substituted hetero-arylene or heteroaryl group; a linear, branched, or cyclic alkenylene or alkenyl group having 2 to 18 carbon atoms, a linear, branched, or cyclic alkynylene or alkynyl group having 2 to 18 carbon atom or an alkoxy group.

When Z is a bi, tri- or quadrivalent linking group, it is preferably represented by an above mentioned terminal group of which hydrogen atoms in numbers corresponding to the valence are eliminated therefrom.

Examples of preferred substituents optionally present on the groups representing $Z^1$ are an alkyl group having up to 12 carbon atoms, an alkoxy group having up to 12 carbon atoms, a halogen atom or a hydroxyl group.

The structural unit represented by the general formula (I) has preferably the following groups:

$X^1$ represents an alkylene, cyclohexylene, phenylene or tolylene group, —O—, —S—, —CO—, —CO—O—, —O—CO—, —CS—, —$NR^hR^i$—, —CO—$NR^h$—, —$NR^h$—CO—, —$NR^h$—CO—O—, —O—CO—$NR^h$—, —$NR^h$—CO—$NR^i$—, —$NR^h$—CS—$NR^i$—, or combinations thereof, and wherein $R^h$ and $R^i$ each independently represent hydrogen or an optionally substituted alkyl, alkenyl, alkynyl, cycloalkyl, heterocyclic, aryl, heteroaryl, aralkyl or heteroaralkyl group. Preferred substituents on the latter groups are an alkoxy group having up to 12 carbon atoms, a halogen or a hydroxyl group;

$Y^1$ is a bivalent sulphonamide group represented by —$NR^j$—$SO_2$—, —$SO_2$—$NR^k$— wherein $R^j$ and $R^k$ each independently represent hydrogen, an optionally substituted alkyl, alkanoyl, alkenyl, alkynyl, cycloalkyl, heterocyclic, aryl, heteroaryl, aralkyl or heteroaralkyl group;

$Z^1$ is a terminal group represented by hydrogen, an alkyl group such as a methyl group, an ethyl group, a propyl group, an isopropyl group, a butyl group, an isobutyl group, a t-butyl group, a s-butyl group, a pentyl group, a hexyl group, a cyclopentyl group, a cyclohexyl group or an octyl group, a benzyl group, an optionally substituted aryl or heteroaryl group, a naphtyl group, an anthracenyl group, a pyridyl group, an allyl group or a vinyl group.

Specific preferred examples of sulphonamide (co)polymers are polymers comprising N-(p-aminosulfonylphenyl) (meth) acrylamide, N-(m-aminosulfonylphenyl) (meth)acrylamide and/or N-(o-aminosulfonylphenyl) (meth)acrylamide. A particularly preferred sulphonamide (co)polymer is a polymer comprising N-(p-aminosulphonylphenyl) methacrylamide wherein the sulphonamide group comprises an optionally substituted straight, branched, cyclic or heterocyclic alkyl group, an optionally substituted aryl group or an optionally substituted heteroaryl group.

The layer comprising the sulphonamide (co)polymer may further comprise additional hydrophobic binders such as a phenolic resin (e.g. novolac, resoles or polyvinyl phenols), a chemically modified phenolic resin or a polymer containing a carboxyl group, a nitrile group or a maleimide group.

The dissolution behavior of the coating of the latter embodiment in the developer can be fine-tuned by optional solubility regulating components. More particularly, development accelerators and development inhibitors can be used.

Development accelerators are compounds which act as dissolution promoters because they are capable of increasing the dissolution rate of the coating. For example, cyclic acid anhydrides as described in U.S. Pat. No. 4,115,128, phenols or organic acids as described in JP 60-88,942 and 2-96,755, can be used in order to improve the aqueous developability.

Developer resistance means, also called development inhibitors are capable of delaying the dissolution of the unexposed areas during processing. The dissolution inhibiting effect is preferably reversed by heating, so that the dissolution of the exposed areas is not substantially delayed and a large dissolution differential between exposed and unexposed areas can thereby be obtained. The compounds described in e.g. EP-A 823 327 and WO97/39894 are believed to act as dissolution inhibitors due to interaction, e.g. by hydrogen bridge formation, with the alkali-soluble resin(s) in the coating. Inhibitors of this type typically comprise at least one hydrogen bridge forming group such as nitrogen atoms, onium groups, carbonyl (—CO—), sulfinyl (—SO—) or sulfonyl (—$SO_2$—) groups and a large hydrophobic moiety such as one or more aromatic rings. Some of the compounds mentioned below, e.g. infrared dyes such as cyanines and contrast dyes such as quaternized triarylmethane dyes can also act as a dissolution inhibitor. Other suitable inhibitors improve the developer resistance because they delay the penetration of the aqueous alkaline developer into the coating. Preferred examples include (i) a polymeric material which is insoluble in or impenetrable by the developer, e.g. a hydrophobic or water-repellent polymer or copolymer; or polymers comprising siloxane (silicones) and/or perfluoroalkyl units; (ii) bifunctional compounds such as surfactants comprising a polar group and a hydrophobic group such as a long chain hydrocarbon group, a poly- or oligosiloxane and/or a perfluorinated hydrocarbon group and (iii) bifunctional block-copolymers comprising a polar block such as a poly- or oligo (alkylene oxide) and a hydrophobic block such as a long chain hydrocarbon group, a poly- or oligosiloxane and/or a perfluorinated hydrocarbon group.

More details concerning development accelerators and development inhibitors can be found in patent applications WO 2004/182,268; WO 2005/058,605; EP 1,543,958; EP 1,588,847.

The coating of the heat-sensitive printing plate precursors described above preferably also contains an infrared light absorbing dye or pigment. Preferred IR absorbing dyes are cyanine dyes, merocyanine dyes, indoaniline dyes, oxonol dyes, pyrilium dyes and squarilium dyes. Examples of suitable IR dyes are described in e.g. EP-As 823327, 978376, 1029667, 1053868, 1093934; WO 97/39894 and 00/29214. Preferred compounds are the following cyanine dyes:

IR-1

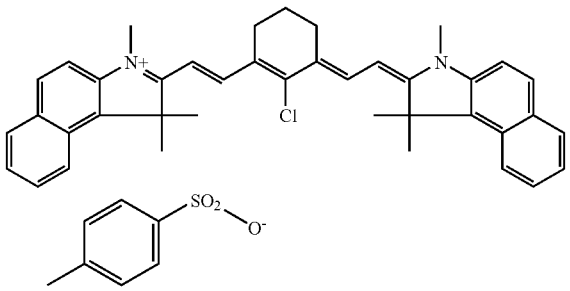

IR-2

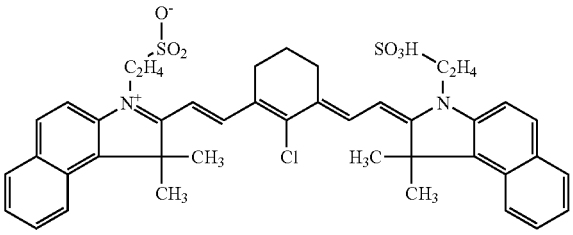

The concentration of the IR-dye in the coating is preferably between 0.25 and 15.0% wt, more preferably between 0.5 and 10.0% wt, most preferably between 1.0 and 7.5% wt relative to the coating as a whole.

The coating may further comprise one or more colorant(s) such as dyes or pigments which provide a visible color to the coating and which remain in the coating at unexposed areas so that a visible image is obtained after exposure and processing. Such dyes are often called contrast dyes or indicator dyes. Preferably, the dye has a blue color and an absorption maximum in the wavelength range between 600 nm and 750 nm.

Although the dye absorbs visible light, it preferably does not sensitize the printing plate precursor, i.e. the coating does not become more soluble in the developer upon exposure to visible light. Typical examples of such contrast dyes are the amino-substituted tri- or diarylmethane dyes, e.g. crystal violet, methyl violet, victoria pure blue, flexoblau 630, basonylblau 640, auramine and malachite green. Also the dyes which are discussed in depth in EP-A 400,706 are suitable contrast dyes.

The heat-sensitive plate precursor can be image-wise exposed directly with heat, e.g. by means of a thermal head, or indirectly by infrared light, preferably near infrared light. The infrared light is preferably converted into heat by an IR light absorbing compound as discussed above. The heat-sensitive lithographic printing plate precursor is preferably not sensitive to visible light, i.e. no substantial effect on the dissolution rate of the coating in the developer is induced by exposure to visible light. Most preferably, the coating is not sensitive to ambient daylight.

The printing plate precursor can be exposed to infrared light by means of e.g. LEDs or a laser. Most preferably, the light used for the exposure is a laser emitting near infrared light having a wavelength in the range from about 750 to about 1500 nm, more preferably 750 to 1100 nm, such as a semiconductor laser diode, a Nd:YAG or a Nd:YLF laser. The required laser power depends on the sensitivity of the plate precursor, the pixel dwell time of the laser beam, which is determined by the spot diameter (typical value of modern plate-setters at $1/e^2$ of maximum intensity: 5-25 μm), the scan speed and the resolution of the exposure apparatus (i.e. the number of addressable pixels per unit of linear distance, often expressed in dots per inch or dpi; typical value: 1000-4000 dpi).

Two types of laser-exposure apparatuses are commonly used: internal (ITD) and external drum (XTD) platesetters. ITD plate-setters for thermal plates are typically characterized by a very high scan speed up to 500 m/sec and may require a laser power of several Watts. XTD plate-setters for thermal plates having a typical laser power from about 200 mW to about 1 W operate at a lower scan speed, e.g. from 0.1 to 10 m/sec. An XTD platesetter equipped with one or more laserdiodes emitting in the wavelength range between 750 and 850 nm is an especially preferred embodiment for the method of the present invention.

The known plate-setters can be used as an off-press exposure apparatus, which offers the benefit of reduced press down-time. XTD plate-setter configurations can also be used for on-press exposure, offering the benefit of immediate registration in a multi-color press. More technical details of on-press exposure apparatuses are described in e.g. U.S. Pat. No. 5,174,205 and U.S. Pat. No. 5,163,368.

After exposure, the precursor can be developed by means of a suitable processing liquid, such as an aqueous alkaline solution, whereby the non-image areas of the coating are removed; the development step may be combined with mechanical rubbing, e.g. by using a rotating brush. During development, any water-soluble protective layer present is also removed. The heat-sensitive printing plate precursors based on latex coalescence, can also be developed using plain water or aqueous solutions, e.g. a gumming solution. The gum solution is typically an aqueous liquid which comprises one or more surface protective compounds that are capable of protecting the lithographic image of a printing plate against contamination or damaging. Suitable examples of such compounds are film-forming hydrophilic polymers or surfactants. The gum solution has preferably a pH from 4 to 10, more preferably from 5 to 8. Preferred gum solutions are described in EP 1,342,568. Alternatively, such printing plate precursors can after exposure directly be mounted on a printing press and be developed on-press by supplying ink and/or fountain to the precursor.

More details concerning the development step can be found in for example EP 1614538, EP 1614539, EP 1614540 and WO/2004071767.

Light-Sensitive Printing Plate Precursors.

In addition to the above thermal materials, also light-sensitive coatings can be used in the methods of the present invention. Typical examples of such plates are the UV-sensitive pre-sensitized plates and the so-called photopolymer plates which contain a photopolymerizable composition that hardens upon exposure to light.

In a particular embodiment of the present invention, a conventional, UV-sensitive "PS" plate is used. Suitable examples of such plates, that are sensitive in the range of 300-450 nm (near UV and blue light), have been discussed in EP 1,029,668 A2. Positive and negative working compositions are typically used in "PS" plates.

The positive working imaging layer preferably comprises an o-naphtoquinonediazide compound (NQD) and an alkali soluble resin. Particularly preferred are o-naphthoquinone-diazidosulphonic acid esters or o-naphthoquinone diazidocarboxylic acid esters of various hydroxyl compounds and o-naphthoquinone-diazidosulphonic acid amides or o-naphthoquinone-diazidocarboxylic acid amides of various aromatic amine compounds. Two variants of NQD systems can be used: one-component systems and two-component systems. Such light-sensitive printing plates have been widely disclosed in the prior art, for example in U.S. Pat. No. 3,635,709, J.P. KOKAI No. 55-76346, J.P. KOKAI No. Sho 50-117503, J.P. KOKAI No. Sho 50-113305, U.S. Pat. No. 3,859,099; U.S. Pat. No. 3,759,711; GB-A 739654, U.S. Pat. No. 4,266,001 and J.P. KOKAI No. 55-57841.

The negative working layer of a "PS" plate preferably comprises a diazonium salt, a diazonium resin or an aryldiazosulfonate homo- or copolymer. Suitable examples of low-molecular weight diazonium salts include: benzidine tetrazoniumchloride, 3,3'-dimethylbenzidine tetrazoniumchloride, 3,3'-dimethoxybenzidine tetrazoniumchloride, 4,4'-diaminodiphenylamine tetrazoniumchloride, 3,3'-diethylbenzidine tetrazoniumsulfate, 4-aminodiphenylamine diazoniumsulfate, 4-aminodiphenylamine diazoniumchloride, 4-piperidino aniline diazoniumsulfate, 4-diethylamino aniline diazoniumsulfate and oligomeric condensation products of diazodiphenylamine and formaldehyde. Examples of diazo resins include condensation products of an aromatic diazonium salt as the light-sensitive substance. Such condensation products are described, for example, in DE-P-1 214 086. The light- or heat-sensitive layer preferably also contains a binder e.g. polyvinyl alcohol.

Upon exposure the diazo resins or diazonium salts are converted from water soluble to water insoluble (due to the destruction of the diazonium groups) and additionally the photolysis products of the diazo may increase the level of crosslinking of the polymeric binder or diazo resin, thereby selectively converting the coating, in an image pattern, from water soluble to water insoluble. The unexposed areas remain unchanged, i.e. water-soluble.

Such printing plate precursors can be developed using an aqueous alkaline solution as described above.

In a second suitable embodiment, the light sensitive printing plate is based on a photo-polymerisation reaction and contains a coating comprising a photocurable composition comprising a free radical initiator (as disclosed in for example U.S. Pat. No. 5,955,238: U.S. Pat. No. 6,037,098; U.S. Pat.

No. 5,629,354; U.S. Pat. No. 6,232,038; U.S. Pat. No. 6,218,076; U.S. Pat. No. 5,955,238; U.S. Pat. No. 6,037,098; U.S. Pat. No. 6,010,824; U.S. Pat. No. 5,629,354; DE 1,470,154; EP 024,629; EP 107,792; U.S. Pat. No. 4,410,621; EP 215,453; DE 3,211,312 and EP A 1,091,247) a polymerizable compound (as disclosed in EP1,161,4541, EP 1349006, WO2005/109103 and ES 2324542, U.S. Pat. No. 8,088,560, U.S. Pat. No. 8,119,330, and U.S. Pat. No. 8,232,043 and a polymeric binder (as disclosed in for example US2004/0260050. US2005/0003285; US2005/0123853; EP 1,369,232; EP 1,369,231; EP 1,341,040; US 2003/0124460, EP 1 241 002, EP 1 288 720, U.S. Pat. No. 6,027,857, U.S. Pat. No. 6,171,735; U.S. Pat. No. 6,420,089: EP 152,819; EP 1,043, 627; U.S. Pat. No. 6,899,994; US2004/0260050; US 2005/0003285; US2005/0170286; US2005/0123853; US2004/0260050; US2005/0003285; US 2004/0260050; US 2005/0003285; US 2005/0123853 and US2005/0123853). Other ingredients such as sensitizers, co-initiators, adhesion promoting compounds, colorants, surfactants and/or printing out agents may optionally be added. These printing plates can be sensitized with blue, green or red light (i.e. wavelength range between 450 and 750 nm), with violet light (i.e. wavelength range between 350 and 450 nm) or with infrared light (i.e. wavelength range between 750 and 1500 nm) using for example an Ar laser (488 nm) or a FD-YAG laser (532 nm), semiconductor lasers InGaN (350 to 450 nm), an infrared laser diode (830 nm) or a Nd—YAG laser (1060 nm).

Typically, a photopolymer plate is processed in alkaline developer having a pH>10 (see above) and subsequently gummed. Alternatively, the exposed photopolymer plate can also be developed by applying a gum solution to the coating whereby the non-exposed areas are removed. Suitable gumming solutions are described in WO/2005/111727. After the exposure step, the imaged precursor can also be directly mounted on a press and processed on-press by applying ink and/or fountain solution. Methods for preparing such plates are disclosed in WO 93/05446, U.S. Pat. No. 6,027,857, U.S. Pat. No. 6,171,735, U.S. Pat. No. 6,420,089, U.S. Pat. No. 6,071,675, U.S. Pat. No. 6,245,481, U.S. Pat. No. 6,387,595, U.S. Pat. No. 6,482,571, U.S. Pat. No. 6,576,401, U.S. Pat. No. 6,548,222, WO 03/087939, US 2003/16577 and US 2004/13968.

To protect the surface of the coating of the heat and/or light sensitive printing plate precursors, in particular from mechanical damage, a protective layer may also optionally be applied. The protective layer generally comprises at least one water-soluble binder, such as polyvinyl alcohol, polyvinylpyrrolidone, partially hydrolyzed polyvinyl acetates, gelatin, carbohydrates or hydroxyethylcellulose, and can be produced in any known manner such as from an aqueous solution or dispersion which may, if required, contain small amounts—i.e. less than 5% by weight based on the total weight of the coating solvents for the protective layer—of organic solvents. The thickness of the protective layer can suitably be any amount, advantageously up to 5.0 μm, preferably from 0.1 to 3.0 μm, particularly preferably from 0.15 to 1.0 μm.

Optionally, the coating may further contain additional ingredients such as surfactants, especially perfluoro surfactants, silicon or titanium dioxide particles or polymers particles such as matting agents and spacers.

Any coating method can be used for applying two or more coating solutions to the hydrophilic surface of the support. The multi-layer coating can be applied by coating/drying each layer consecutively or by the simultaneous coating of several coating solutions at once. In the drying step, the volatile solvents are removed from the coating until the coating is self-supporting and dry to the touch. However it is not necessary (and may not even be possible) to remove all the solvent in the drying step. Indeed the residual solvent content may be regarded as an additional composition variable by means of which the composition may be optimized. Drying is typically carried out by blowing hot air onto the coating, typically at a temperature of at least 70° C., suitably 80-150° C. and especially 90-140° C. Also infrared lamps can be used. The drying time may typically be 15-600 seconds.

Between coating and drying, or after the drying step, a heat treatment and subsequent cooling may provide additional benefits, as described in WO99/21715, EP-A 1074386, EP-A 1074889, WO00/29214, and WO/04030923, WO/04030924, WO/04030925.

The printing plates thus obtained can be used for conventional, so-called wet offset printing, in which ink and an aqueous dampening liquid are supplied to the plate. Another suitable printing method uses so-called single-fluid ink without a dampening liquid. Suitable single-fluid inks have been described in U.S. Pat. No. 4,045,232; U.S. Pat. No. 4,981,517 and U.S. Pat. No. 6,140,392. In a most preferred embodiment, the single-fluid ink comprises an ink phase, also called the hydrophobic or oleophilic phase, and a polyol phase as described in WO 00/32705.

The coatings described herein can also be used as a thermoresist for forming a pattern on a substrate by direct imaging techniques, e.g. in a PCB (printed circuit board) application as described in US 2003/0003406 A1.

The invention claimed is:

1. A method for making a lithographic printing plate support comprising the steps of:

(i) providing an aluminum support;

(ii) treating said support in an aqueous solution; and (iii) graining said treated support in an electrolyte solution by applying an alternating voltage to said support thereby inducing a local current density (J) at the surface of said support, wherein said local current density J at time (t) fulfills the following equation:

$$J(t) \leqq a + bQ(t)$$

for t=0 to t=tf and wherein in the equation

Q(t) is the integrated value of the absolute value of the local current density J(t) at time t:

$$Q(t) = \int_0^t |J(\tau)| d\tau$$

a is 5, 3.5 or 2.9, b is 10, 9.0 or 8.6, and tf is the time necessary to obtain a value of Q(t) equal to 80, 50 or 10 C/dm$^2$, wherein the unit of J(t) is A/dm$^2$.

2. The method according to claim 1 wherein a is 3.5.

3. The method according to claim 1 wherein b is 9.0.

4. The method according to claim 1 wherein a is 2.9 and b is 8.6.

5. The method according to claim 1 wherein Q(t) is equal to 10 C/dm$^2$.

6. The method according to claim 1 wherein the electrolyte solution comprises HCl.

7. The method according to claim 1 wherein the aqueous solution comprises the electrolyte solution.

8. The method according to claim 1 wherein the aqueous solution has the same chemical composition as the electrolyte solution.

9. The method according to claim 1 wherein the temperature during step (ii) is at least 25° C.

10. The method according to claim 1 wherein step (ii) is performed in one or more washing bath(s) and step (iii) is performed in one or more graining bath(s), wherein the level of said aqueous solution in said washing bath(s) is kept at a constant level by pumping said electrolyte solution from the graining bath(s) to the washing bath(s).

11. The method according to claim 10 wherein the temperature of the aqueous solution in the washing bath(s) is controlled within a range from 35 to 45° C.

12. A method for making a lithographic printing plate precursor comprising the steps of (i) providing a support obtained by the method of claim 1;

(ii) applying a coating comprising at least one heat- or light-sensitive imaging layer onto said support; and (iii) drying the coated support to provide the precursor.

13. The method according to claim 1 wherein a is 5 and b is 10.

14. The method according to claim 1 wherein a is 3.5 and b is 9.

15. The method according to claim 1 wherein Q(t) is equal to 80 C/dm$^2$.

16. The method according to claim 1 wherein Q(t) is equal to 50 C/dm$^2$.

17. The method according to claim 1 wherein Q(t) is equal to 10 C/dm$^2$.

18. The method according to claim 13 wherein Q(t) is equal to 80 C/dm$^2$.

19. The method according to claim 13 wherein Q(t) is equal to 50 C/dm$^2$.

20. The method according to claim 13 wherein Q(t) is equal to 10 C/dm$^2$.

21. The method according to claim 14 wherein Q(t) is equal to 80 C/dm$^2$.

22. The method according to claim 14 wherein Q(t) is equal to 50 C/dm$^2$.

23. The method according to claim 14 wherein Q(t) is equal to 10 C/dm$^2$.

24. The method according to claim 4 wherein Q(t) is equal to 80 C/dm$^2$.

25. The method according to claim 4 wherein Q(t) is equal to 50 C/dm$^2$.

26. The method according to claim 4 wherein Q(t) is equal to 10 C/dm$^2$.

27. The method according to claim 9 wherein the temperature during step (ii) is at least 35° C.

28. The method according to claim 17 wherein the temperature during step (ii) is at least 35° C.

29. The method according to claim 20 wherein the temperature during step (ii) is at least 35° C.

30. The method according to claim 23 wherein the temperature during step (ii) is at least 35° C.

31. A method for making a lithographic printing plate support comprising the steps of:

providing an aluminum support;

(ii) treating said support in an aqueous solution; and (iii) graining said treated support in an electrolyte solution by applying an alternating voltage to said support thereby inducing a local current density (J) at the surface of said support, wherein said local current density j at time (t) fulfills the following equation:

$$J(t) \leqq a + bQ(t)$$

for t=0 to t=tf and wherein in the equation

Q(t) is the integrated value of the absolute value of the local current density J(t) at time t:

$$Q(t) = \int_0^t |J(\tau)| d\tau$$

a is 5, 3.5 or 2.9, b is ≦8.6, and if is the time necessary to obtain a value of Q(t) equal to 80, 50 or 10 C/dm$^2$, wherein the unit of J(t) is A/dm$^2$.

32. The method according to claim 31 wherein Q(t) is equal to 80 C/dm$^2$.

33. The method according to claim 31 wherein Q(t) is equal to 50 C/dm$^2$.

34. The method according to claim 31 wherein Q(t) is equal to 10 C/dm$^2$.

35. The method according to claim 31 wherein the temperature during step (ii) is at least 35° C.

36. A method for making a lithographic printing plate precursor comprising the steps of (i) providing a support obtained by the method of claim 31;

(ii) applying a coating comprising at least one heat- or light-sensitive imaging layer onto said support; and (iii) drying the coated support to provide the precursor.

* * * * *